US006499990B1

(12) United States Patent
Zink et al.

(10) Patent No.: US 6,499,990 B1
(45) Date of Patent: Dec. 31, 2002

(54) LOW $NO_X$ BURNER APPARATUS AND METHOD

(75) Inventors: Darton J. Zink, Tulsa, OK (US); Rex K. Isaacs, Tulsa, OK (US); Tim Kirk, Morris, OK (US); John McDonald, Broken Arrow, OK (US)

(73) Assignee: Zeeco, Inc., Broken Arrow, OK (US)

( * ) Notice: Subject to any disclaimer, the term of this patent is extended or adjusted under 35 U.S.C. 154(b) by 0 days.

(21) Appl. No.: 09/800,704

(22) Filed: Mar. 7, 2001

(51) Int. Cl.[7] ..... F23D 14/22

(52) U.S. Cl. ..... 431/8; 431/9; 431/115; 431/174; 431/178

(58) Field of Search ..... 431/8, 9, 115, 431/116, 157, 174, 178, 202, 285, 278, 348, 350

(56) References Cited

U.S. PATENT DOCUMENTS

| | | | | |
|---|---|---|---|---|
| 4,277,942 A | | 7/1981 | Egnell et al. | |
| 4,395,223 A | | 7/1983 | Okigami et al. | |
| 4,505,666 A | | 3/1985 | Martin et al. | |
| 4,575,332 A | | 3/1986 | Oppenberg et al. | |
| 4,708,638 A | | 11/1987 | Brazier et al. | |
| 5,044,932 A | | 9/1991 | Martin et al. | |
| 5,073,105 A | | 12/1991 | Martin et al. | |
| 5,098,282 A | | 3/1992 | Schwartz et al. | |
| 5,195,884 A | | 3/1993 | Schwartz et al. | |
| 5,688,115 A | * | 11/1997 | Johnson | 431/115 |
| 6,007,325 A | * | 12/1999 | Loftus et al. | 431/116 |
| 2001/0034001 A1 | * | 10/2001 | Poe et al. | 431/116 |

FOREIGN PATENT DOCUMENTS

| | | | | |
|---|---|---|---|---|
| SU | 1179016 A | * | 9/1985 | 431/8 |
| WO | WO 90/04740 | | 5/1990 | |

* cited by examiner

*Primary Examiner*—Sara Clarke
(74) *Attorney, Agent, or Firm*—Fellers, Snider, Blankenship, Bailey & Tippens, P.C.

(57) ABSTRACT

A burner and method for reducing $NO_x$ emissions from process heaters, boilers, and other heating systems having flue gases present therein. The inventive burner and method preferably involve the single stage combustion of fuel gas which is ejected outside of a burner wall in free jet flow such that at least a portion of the flue gas is entrained in the fuel gas as it travels to a combustion zone at the forward end of the burner wall. Air or other oxygen-containing gas is preferably delivered to the combustion zone via an interior passageway. The inventive burner preferably comprises a plurality of ejectors positioned outside of the burner wall and preferably also comprises one or more exterior impact structures positioned to assist in further mixing the flue gas with the fuel.

58 Claims, 7 Drawing Sheets

LOW $NO_X$ BURNER APPARATUS AND METHOD

FIELD OF THE INVENTION

In one aspect, the present invention relates to methods and apparatuses for reducing $NO_x$ emissions from burners of the type used in process heater, boilers, and other fired heating systems. More particularly, but not by way of limitation, the present invention relates to achieving low $NO_x$ emissions in and with a burner having only one combustion stage.

BACKGROUND OF THE INVENTION

Many industrial applications require large scale generation of heat from burners for process heaters, boilers, or other fired heating systems. If the burner fuel is thoroughly mixed with air and combustion occurs under ideal conditions, the resulting combustion products are primarily carbon dioxide and water vapor. However, when the fuel is burned under less than ideal conditions, such as in a high temperature environment, nitrogen present in the combustion air reacts with oxygen to produce nitrogen oxides ($NO_x$). It is well known that, other conditions being equal, $NO_x$ production increases as the temperature of the combustion process increases. $NO_x$ emissions are generally considered to contribute to ozone depletion and other environmental problems.

Prior to today's increasing concern over the environmental effects of $NO_x$, emissions, single staged burners were in common use in generally all types of fired heater applications. Prior art single stage burners typically comprise one or more fuel nozzles or distributors positioned inside the burner wall. As compared to typical low $NO_x$, burners now in use, the prior art single stage burners are less expensive, less complex, safer, more stable, and simpler to operate, control, and maintain. Prior art single stage burners also typically provide much broader acceptable operating ranges (turndown ratios). Unfortunately, however, the simpler single stage burners heretofore used in the art produce very high levels of $NO_x$, emissions and are not capable of meeting today's demanding environmental standards and regulations.

Burners designed for combusting fuel with air in a manner resulting in less $NO_x$ emissions are commonly referred to as "low $NO_x$" burners. One type of apparatus now used for reducing $NO_x$ emissions is a "staged air" burner. Staged air burners operate by dividing the flow of combustion air to create a first combustion zone (wherein the fuel is introduced) having a deficiency of air so as to create a reducing environment that suppresses $NO_x$ formation and a second combustion zone wherein the remaining portion of air is introduced and the combustion process is completed.

Another type of low $NO_x$ apparatus is a "staged fuel" burner wherein all of the combustion air, but only a portion of the fuel to be burned, are introduced in a first combustion zone. The remaining fuel is introduced into a second combustion zone utilizing the oxygen-rich effluent of the first zone. In such a burner, the excess air in the first zone serves to dilute the fuel, which lowers the temperature of the burning gases and thereby reduces the formation of $NO_x$.

Other low $NO_X$ methods and apparatuses recirculate and mix furnace flue gases with fuel/air mixtures to dilute the mixtures and to thereby lower the combustion temperature so that $NO_x$ formation is reduced. Flue gases are captured from the furnace space and conducted via pipes, ducts, or passageways to a mixer assembly, typically within the burner housing, where the flue gases are mixed with fuel or with fuel and air. The resulting mixture is then burned.

It will be appreciated that to accomplish the foregoing, each of the conventional types of low $NO_x$ burners must be rather complex in structure and operation. As compared to high $NO_x$ prior art single stage burners, conventional low $NO_x$ systems must provide for and include additional hardware, conduits, passageways and other structures to achieve staged introduction of fuel or air, to allow for the burning of fuel/air mixtures in multiple combustion zones, and/or to accommodate the recirculation of furnace gases. This increased level of complexity does not lend itself to low-cost manufacture, reliability, or ease of maintenance. Moreover, in staged burner systems, the necessity of splitting flows to and balancing the performance of multiple combustion zones/stages increases the difficulty of achieving and maintaining operational stability and greatly reduces the available operating range (turndown ratio) of the burner.

One type of low $NO_x$ staged fuel burner heretofore known in the art is described in U.S. Pat. No. 5,195,884. In the '884 burner, a primary portion (preferably about 75%) of the fuel gas used in the burner must be burned in a first ("primary") combustion zone within and surrounded by the burner wall. The primary fuel is mixed with air and discharged into the primary combustion zone using one or more mixing and discharge assemblies which project into and are at least partially contained within the throat of the burner. Each of these assemblies comprises a Venturi aspirating tube having a primary fuel gas nozzle positioned at the lower end thereof.

The remaining (secondary) fuel gas used in the '884 burner is delivered to a secondary combustion zone by four secondary fuel gas nozzles outside of the burner wall. Each of the secondary fuel nozzles has an array of multiple flow ports provided therein which must spread the secondary flue gas in a fan-type pattern covering essentially one-quarter of the exterior of the burner wall. The burner wall has an exterior frusto-conical surface which is contacted by the secondary fuel gas as it spreads outwardly and moves upwardly to the secondary combustion zone. Such contact is said to promote the mixing of internal flue gases with the secondary fuel gas.

Unfortunately, the primary combustion stage alone of the burner described in the '884 patent produces more $NO_x$ emissions than are allowable, for example, under Texas Gulf Coast restrictions and other regulatory requirements. Moreover, without using the primary combustion stage, it has not been possible heretofore to obtain adequate heating or to achieve and maintain stable burner operation.

Like the stage fuel burner described in the '884 patent, few, if any, of the other low $NO_x$ burners presently available are capable of meeting Texas Gulf Coast requirements and other increasingly stringent air quality standards. If suitable new burner technologies capable of satisfying these requirements are not found, the industry will be required to use more expensive and elaborate techniques, such as catalytic reduction, to reduce $NO_x$ emissions.

Thus, a need exists for a new burner technology which produces even less $NO_x$ emissions than the low $NO_x$ burner systems currently available in the art. The new, extremely low $NO_x$ burner would preferably also be less complex, less expensive, more stable, and much simpler to operate, maintain, and control than current low $NO_x$ burner systems. Further, the new, extremely low $NO_x$ burner would preferably provide a much larger available turndown ratio than is provided by current low $NO_x$ burners.

SUMMARY OF THE INVENTION

The present invention provides a low $NO_x$ burner apparatus and method which satisfy the needs and alleviate the problems discussed above. The inventive burner and method are capable of providing $NO_x$ emission levels of 10 parts per million by volume (ppmv) or less (preferably 7 ppmv or less) based on the total volume of combustion gas product produced by the burner. The inventive low $NO_x$ burner also provides much stabler operation and is less complex and less costly than the low $NO_x$ burner systems currently available. Moreover, the inventive burner is much simpler to maintain and control and provides a desirably broad available operating range. In this regard, the inventive burner has a turndown ration in the range of from about 5:1 to about 10:1, comparable to the broad operating ranges provided by prior high $NO_x$ burners.

The inventive burner and method also greatly reduce the need for metal components within the throat of the burner, thus allowing the size of the burner to be significantly reduced. This, coupled with the desirably broad turndown ratio provided by the inventive burner, allows the furnace operator to achieve and maintain more optimum, stable heat flux characteristics and also allows the inventive burner to be more easily sized as needed. Thus, the inventive burner can be conveniently used in existing heaters, boilers, etc. to replace most existing conventional or staged fuel burners with, at most, only minor modifications to the furnace structure.

In one aspect, the present invention involves a burner providing reduced $NO_x$ emissions for use in a heating system having a flue gas therein. The burner comprises: (a) a burner wall having a forward end and (b) a series of fuel gas ejectors, each having only a single fuel gas ejection port provided therein. The ejectors and the single fuel gas ejection ports provided therein are positioned and the fuel gas ejection ports are configured to deliver fuel gas from the ejectors in adjacent, free jet flow streams outside of the burner wall toward a combustion zone at the forward end of the burner wall. Each of the adjacent free jet flow streams is effective for entraining a portion of the flue gas in the fuel gas.

In another aspect, the present invention involves a burner providing reduced $NO_x$ emissions for use in a heating system having a flue gas therein, the burner comprising: (a) a burner wall having a forward end and (b) a plurality of fuel gas ejectors positioned longitudinally rearward end and laterally outward from the forward end of the burner wall. The burner has only a single combustion stage consisting essentially of a combustion zone beginning at the forward end of the burner wall such that, apart from any pilot fuel employed elsewhere in the burner, substantially all fuel used by the burner is combusted in the combustion zone. The fuel gas ejectors are configured and positioned to deliver fuel gas to the combustion zone in ejection flow paths outside of the burner wall in a manner effective such that at least a sufficient portion of the flue gas is entrained in the fuel gas to yield total $NO_x$ emissions of less than 10 parts per million by volume of all combustion product gases produced by the burner.

In yet another aspect, the present invention involves a burner providing reduced $NO_x$ emissions comprising: a burner wall having a forward end; at least one fuel gas nozzle positioned longitudinally rearward of and laterally outward from the forward end of the burner wall; at least one fuel gas delivery port positioned in the fuel gas nozzle to deliver fuel gas in a flow path outside of the burner wall to a combustion zone at the forward end of the burner wall; and at least one exterior ledge provided on the burner wall and positioned between the fuel gas delivery port and the forward end of the burner wall such that at least a portion of the fuel gas traveling in the flow path will contact the ledge.

In yet another aspect, the present invention involves a burner providing reduced $NO_x$ emissions comprising: a burner wall having a forward end; at least one fuel gas nozzle having at least one fuel gas delivery port positioned therein to deliver fuel gas in a flow path outside of the burner wall to a combustion region at the forward end of the burner wall; and a plurality of impact structures, not including the forward end of the burner wall, positioned such that each of the impact structures will be contacted by at least a portion of the fuel gas traveling in the flow path.

In yet another aspect, the present invention provides a method of reducing $NO_x$ emissions from a burner used in a heating system having a flue gas therein, wherein the burner includes a burner wall having an interior passageway with an outlet at the forward end of the burner wall. The method comprises the steps of: (a) ejecting fuel gas outside of the burner wall in free jet flow such that at least a portion of the flue gas is entrained in the fuel gas and the fuel gas travels outside of the burner wall to a combustion zone at the forward end of the burner wall and (b) delivering air or other oxygen-containing gas to the combustion zone via the interior passageway. The burner is operated in the inventive method as a single stage burner wherein, apart from any pilot fuel employed elsewhere in the burner, substantially all fuel used by the burner is combusted in the combustion zone at the forward end of the burner wall.

A better understanding of the present invention, its several aspects, and its advantages will become apparent to those skilled in the art from the following detailed description, taken in conjunction with the attached drawings, wherein there is shown and described the preferred embodiments of the invention, simply by way of illustration of the best mode contemplated for carrying out the invention.

DETAILED DESCRIPTION OF THE PREFERRED EMBODIMENTS

Before explaining the present invention in detail, it is important to understand that the invention is not limited in its application to the details of the preferred embodiments and steps described herein. The invention is capable of other embodiments and of being practiced or carried out in a variety of ways. It is to be understood that the phraseology and terminology employed herein is for the purpose of description and not of limitation.

Although all of the embodiments of the inventive burner described below are single stage combustion apparatuses, it will be understood by those skilled in the art that each of the various inventive features, structures, and steps discussed herein can also be employed in multiple stage combustion systems for reducing $NO_x$ emissions. Moreover, such features and steps can be advantageously employed using only one or any other number exterior fuel ejection nozzles, each having any number of flow ejection ports provided therein. Additionally, it will be understood that the inventive burners described herein can be oriented upwardly, downwardly, horizontally, or at generally any other desired operating angle.

As will be understood by those skilled in the art, the term "free jet," as used herein and in the claims, refers to a jet flow issuing from a nozzle into a fluid which, compared to the jet flow, is more at rest. In this case, the fluid issuing from the nozzle is preferably fuel gas and the fluid substantially at rest is the flue gas present within the heating system. For purposes of the present invention, the heating system can be a process heater, a boiler or generally any other type of heating system used in the art. The flue gas present within the system will comprise the gaseous products of the combustion process. The fuel gas used in the inventive burner and method can be natural gas or generally any other type of gas fuel or gas fuel blend employed in process heaters, boilers, or other gas-fired heating systems. The free jet flow employed in the inventive system operates to entrain flue gas and to thoroughly mix the flue gas with the fuel gas stream as it travels to the combustion zone at the outlet end of the burner wall.

Figure 1:
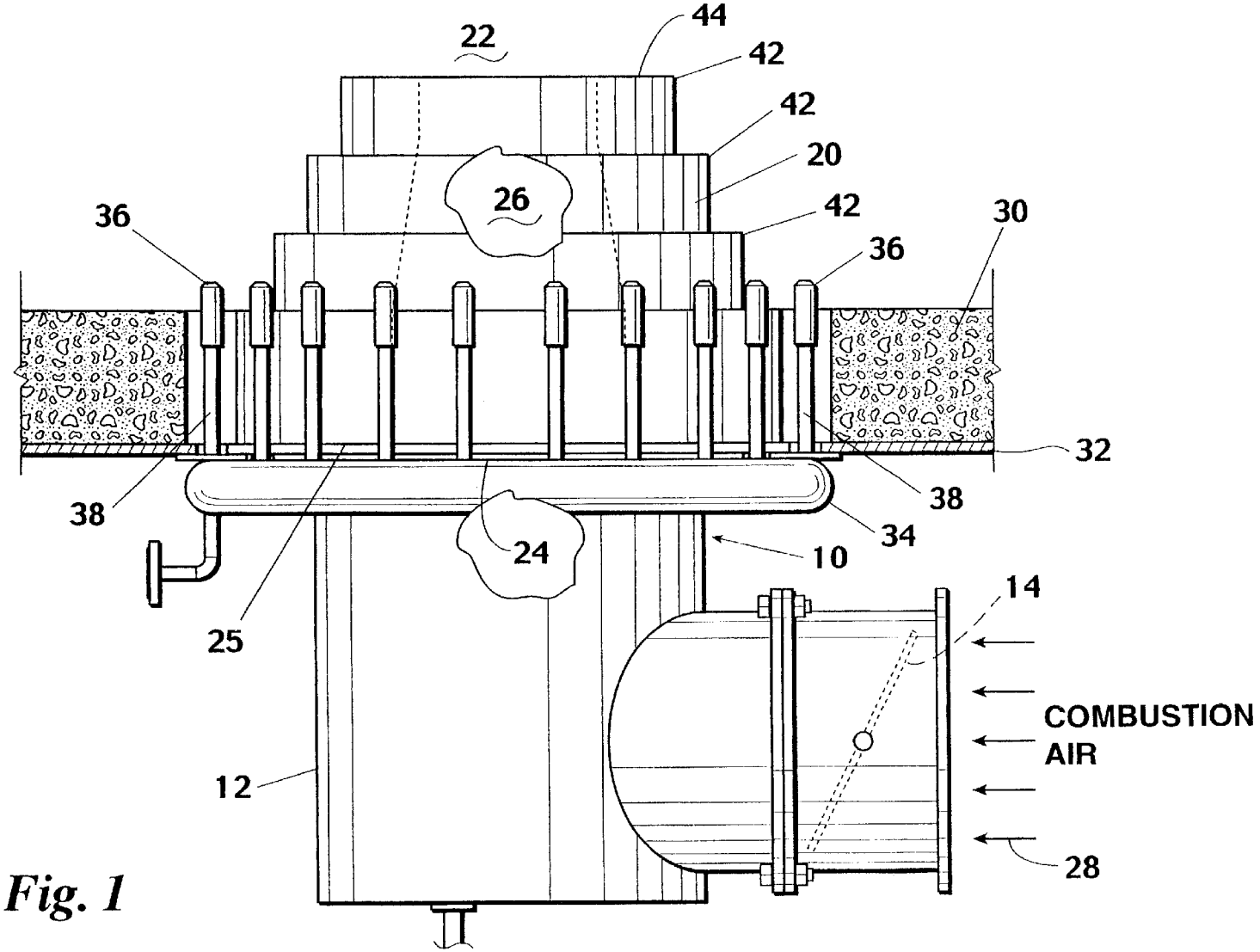
FIG. 1 is an elevational outer view of an embodiment 10 of the burner provided by present invention.

Referring now to the drawings, FIG. 1 depicts an embodiment 10 of the inventive burner apparatus. Burner 10 is a single stage burner comprising a housing 12 and a burner wall 20 having an outlet or forward end 22, a base end 25, and a central passageway or throat 26 extending therethrough. The burner wall 20 is preferably constructed of a high temperature refractory burner tile material. The outlet end 22 of burner 10 is in communication with the interior of the furnace or other heating system enclosure in which combustion takes place and which therefore contains combustion product gases (i.e., flue gas). Burner 10 is shown as installed through a furnace wall 32, typically formed of metal. Insulating material 30 will typically be secured to the interior of furnace wall 32.

Combustion air or other oxygen-containing gas 28 is received in housing 12 and directed thereby into the inlet end 24 of burner throat 26. The air 28 exits the burner at the outlet end 22 thereof. The quantity of combustion air entering housing 12 is regulated by combustion air inlet damper 14. The air 28 can be provided to housing 12 as necessary by forced circulation, natural draft, a combination thereof, or in any other manner employed in the art.

A series of outer ejection tips, nozzles, or other fuel gas ejectors surrounds burner wall 20. In embodiment 10 of the inventive burner, each ejector is depicted as comprising a fuel ejection tip 36 secured over the end of a fuel pipe 38. Each fuel pipe 38 is in communication with a fuel supply manifold 34 and can either extend through a lower skirt portion of the burner tile 20 or be affixed within the insulating material 30 attached to furnace wall 32. While fuel pipes 38 are illustrated as being connected to a fuel supply manifold 34, it will be understood that any other type of fuel supply system can also be used in the present invention.

As indicated above, each of the fuel gas ejectors 36 can have any desired number of ejection ports provided therein. Such ports can also be of any desired shape and can be arranged to provide generally any desired pattern or regime of fuel gas flow on the outside of burner wall 20. However, in contrast to existing multistage burners of the type having one or more exterior nozzles for the purpose of supplying only a spread flow of supplemental fuel to a secondary combustion zone, each of ejectors 36 employed in burner 10 preferably has only a single ejection port 45 provided therein. Each ejection port 45 is preferably oriented to deliver a single free jet fuel gas flow stream 50 directly toward a sole combustion zone 46 located and beginning at the outer end of burner wall 20. As each free jet fuel gas stream 50 flows toward combustion zone 46, flue gas from the furnace enclosure is entrained therein and thoroughly mixed therewith. We have discovered that, by ejecting the fuel gas in this unique manner, it can be sufficiently conditioned with flue gas for single stage, low $NO_x$ combustion.

The individual ejection ports 45 provided in ejectors 36 can be of any shape capable of providing the free jet flow and degree of entrainment and mixing desired. Examples of suitable shapes include but are not limited to circles, ellipses, squares, rectangles, and supersonic-type ejection orifices. Additionally, the individual ejection orifices 45 of all of ejectors 36 can be of the same shape or can be of any desired combination of differing acceptable shapes. Each ejection port 45 and the fuel supply manifold 34 associated therewith will most preferably be sized to deliver fuel gas therefrom at an ejection rate in the range of from about 900 to about 1500 feet per second and will more preferably be sized to eject fuel gas at from about 1,100 to about 1,300 feet per second.

As depicted in the drawings, ejectors 36 are preferably located in proximity to the base 25 of burner wall 20 such that they are positioned longitudinally rearward of and laterally outward from the outer or forward end 22 of the burner wall. The angular orientation of the fuel gas jet flow streams 50 toward combustion zone 46 will be a function of the height and diameter or width of the burner wall 20, the spacing of ejectors 36 from the base 25 of the burner wall, the height of the individual ejector fuel pipes 38, etc. However, ejectors 36 and the individual flow ports 45 provided therein will preferably be positioned such that each fuel gas free jet flow stream 50 will be ejected from flow port 45 at an angle in the range of from about 13° to about 26° with respect to the longitudinally axis 57 of the burner. Each of the free jet flow streams 50 is most preferably oriented at an angle of about 18° from longitudinal axis 57.

Depending primarily upon the size of the burner and the capacity requirements of the particular application in question, generally any number and spacing of ejectors 36 can be used. The spacing between adjacent pairs of ejectors will typically be the same, but can be different. In order to provide optimum performance and fuel gas conditioning (i.e., flue gas entrainment and mixing) for most applications, the inventive burner will preferably employ a series of at least 10 ejectors positioned relatively close to each other such that the ejectors 36 provide an array of adjacent fuel gas jet flow streams 50 traveling together toward combustion zone 46. Adjacent pairs of ejectors 36 will preferably be spaced a sufficient distance apart, however, such that neighboring ejectors 36 will not interfere with the free jet entrainment of the fuel gas streams 50 as they leave ejector ports 45. Each adjacent pair of ejectors 36 will preferably be spaced from about 1 to about 4 inches apart. Each pair of adjacent ejectors 36 will more preferably be spaced from about 1 inch to about 3 inches apart and will most preferably be spaced about two inches apart.

As illustrated hereinbelow, the burner wall 20 of inventive burner 10 can be circular, square, rectangular, or generally any other desired shape. In addition, the series of fuel ejectors 36 employed in the inventive burner need not entirely surround the base of the burner wall. For example, the ejectors 36 may not completely surround the burner wall in certain applications where the inventive burner is used in a furnace sidewall location or must be specially configured to provide a particular desired flame shape.

To further facilitate the entrainment and mixing of flue gas in the fuel gas jet flow streams 50, the inventive burner preferably comprises one or more exterior impact structures positioned at least partially within the paths of flow streams 50. Each such impact structure can generally be any type of obstruction which will decrease the flow momentum and/or increase the turbulence of the fuel gas streams 50 sufficiently to promote flue gas entrainment and mixing while allowing the resulting mixture to flow on to combustion zone 46. Although other types of impact structures can be employed, the impact structure(s) used in the inventive burner will most preferably be of a type which can be conveniently formed in a poured refractory as part of and/or along with the burner wall 20. The inventive burner will most preferably employ at least two impact structures spaced apart from each other.

The burner wall 20 employed in inventive burner 10 has been formed to provide a particularly desirable tiered exterior shape wherein the diameter of the base 25 of the burner wall is broader than the forward end 22 thereof and the exterior of the burner wall 20 presents a series of concentric, spaced apart, impact ledges 42. The outermost impact ledge 42 is defined by the outer edge of the forward end 22 of burner wall 20. At least one, preferably at least two, additional impact ledges 42 are then positioned on the exterior of burner wall 20 between ejectors 36 and forward end 22. Proceeding from the outer end 22 to the base 25 of the burner wall, each additional ledge 42 is preferably broader in diameter than and is spaced longitudinally rearward of and laterally outward from the previous ledge.

Although the inventive impact structures 42 of burner 10 are depicted as used in a single stage burner having multiple fuel jet ejectors surrounding the burner wall, it will be understood by those skilled in the art that the novel impact ledges 42, as well as any of the other types of impact structures described herein, can alternatively be used for improving flue gas entrainment and mixing in appropriate types of multiple stage burners and other devices having at least one exterior fuel gas nozzle.

As illustrated, for example, in FIG. 1, the air flow passageway 26 extending through burner wall 20 preferably comprises a tapered throat having a wider diameter at base 25 than at the outer end 22 of the burner wall. A tapered throat 26 of the type depicted in FIG. 1 desirably provides a choke point for air flow at or near the outer end 22 of the burner and also desirably facilitates the creation of a reduced pressure region of the type discussed hereinbelow at the outer end of the burner.

In stark contrast to the multiple stage approaches and/or other elaborate systems heretofore believed to be essential for reducing $NO_x$ formation, inventive burner 10 provides extremely low $NO_x$ emissions while desirably employing only a single combustion zone 46. Except for any pilot fuel which, as indicated hereinbelow, may be introduced elsewhere in the burner, all of the fuel used in inventive burner 10 can be combusted in zone 46. Because the entire quantity of fuel gas used in the inventive burner is so well conditioned with furnace flue gases prior to mixing with the air 28 in combustion zone 46, combustion occurs at a significantly reduced flame temperature, thus resulting in lower $NO_x$ emissions. Further, the inventive burner is less expensive to manufacture in that it eliminates the requirement for additional hardware for staged fuel or air, such as primary and secondary risers and fuel tips. It also eliminates the need for complicated flue gas mixing apparatuses and for separate conduits, passageways and other structures for delivering fuel, air or flue gases to a separate ignition zone or multiple combustion zones.

Figure 3B:
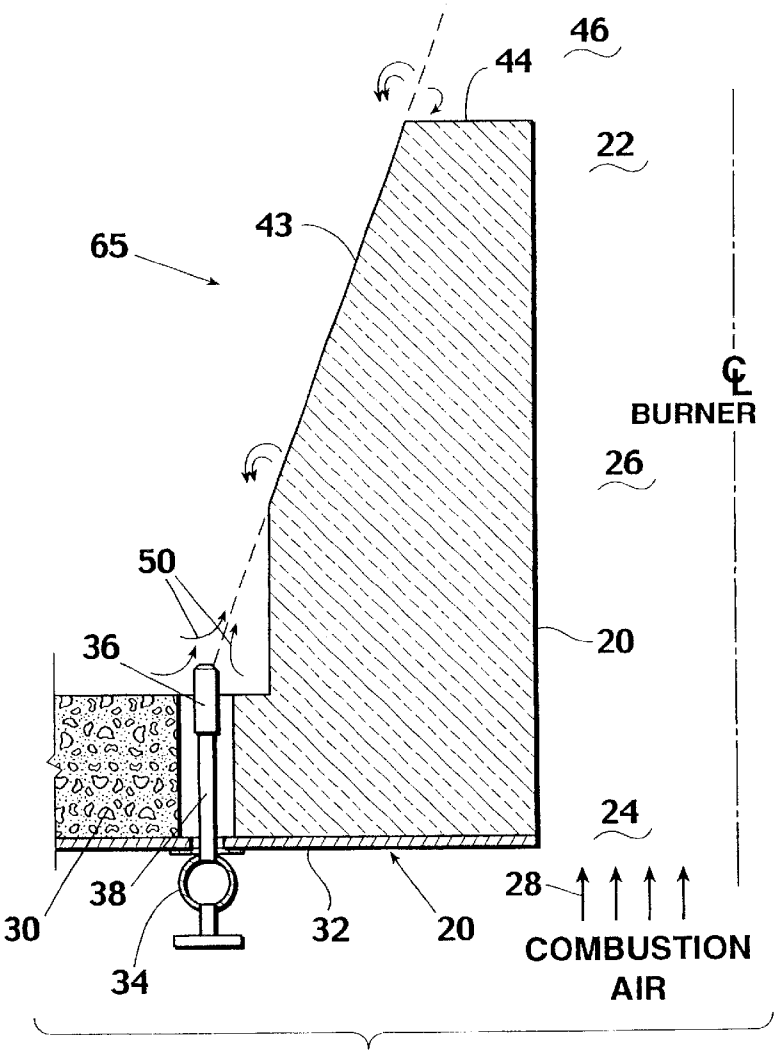
FIG. 3B is a partial, cutaway elevational view of yet another alternative embodiment 65 of the inventive burner.
Figure 3A:
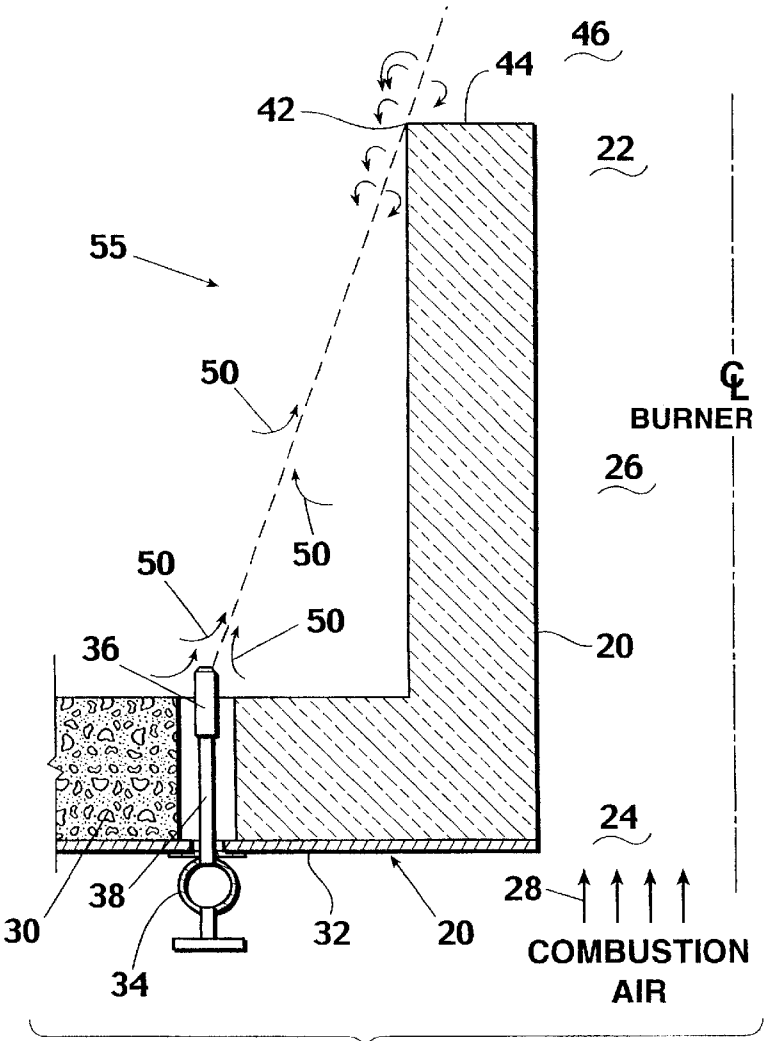
FIG. 3A is a partial, cutaway elevational view of an alternative embodiment 55 of the inventive burner.

An alternative embodiment 55 of the inventive burner is depicted in FIG. 3A. Burner 55 is substantially identical to burner 10 except that the exterior of the burner wall is substantially cylindrical in shape such that the burner has only a single impact ledge 42 provided at the outer end 44 thereof.

FIG. 3B shows another alternate embodiment 65 of the inventive burner having a sloped impact surface 43 provided on the exterior of burner wall 20. Sloped surface 43 tapers inwardly toward outer end 44.

Figure 4:
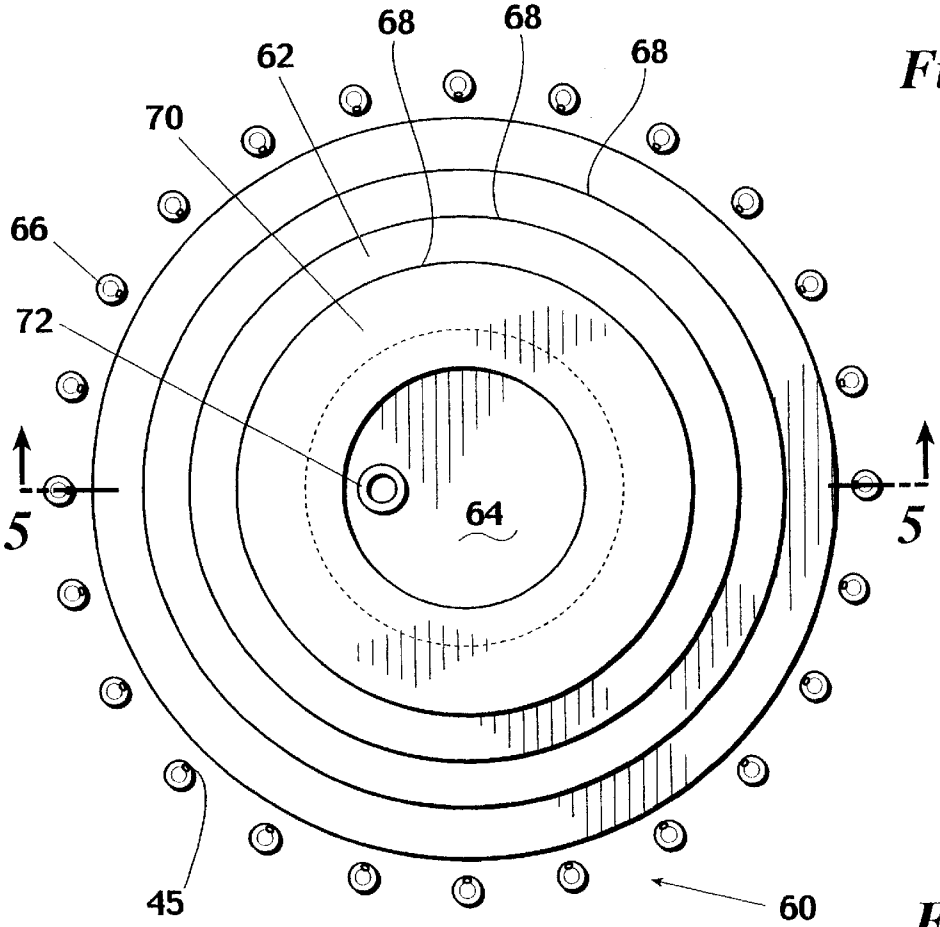
FIG. 4 is a top view of a circular form 60 of inventive burner 10.
Figure 5:
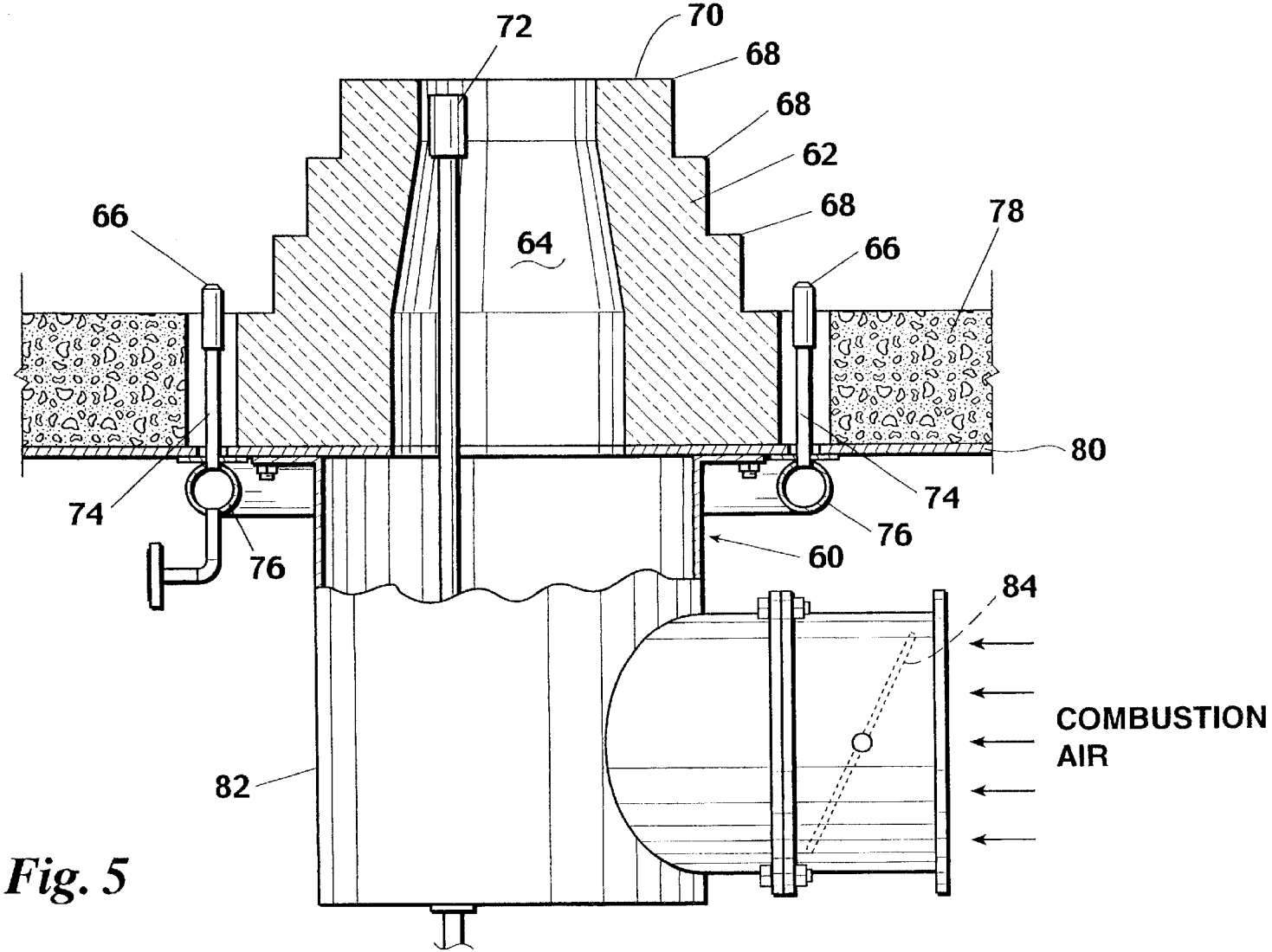
FIG. 5 is cutaway elevational view of circular burner 60 as seen from perspective A—A shown in FIG. 4.

FIGS. 4 and 5 illustrate one form 60 of inventive burner 10 wherein the lateral cross-section of the burner wall is circular in shape. FIG. 4 is a distal, outer end view of the circular burner 60 wherein the burner wall 62 possesses a plurality of ledges 68 of a progressively decreasing diameter (from the base end to the outer end of the burner wall) about an interior opening 64 through which combustion air or other oxygen-containing gas passes. A plurality of fuel ejection tips 66 are circumferentially located outside the burner wall 62. A burner pilot 72 can optionally be located within the interior opening 64 to initiate combustion at the outer end 70 of the burner.

FIG. 5 provides a sectional side view of inventive circular burner 60. The fuel ejection tips 66 are connected to fuel pipes 74 that are in communication with a fuel supply manifold 76. Fuel pipe 74 preferably extends through either the burner tile 62 or the insulating material 78 attached to the furnace wall 80. Recesses or channels in the burner tile 62 or insulating material 78 may be used to house the fuel ejection tips 66 and fuel pipes 74. Burner 60 includes a cylindrical housing 82 through which combustion air or other oxygen-containing gas is directed to the interior passageway or throat 64 formed through the burner wall 62. The quantity of combustion air entering the cylindrical housing 82 is regulated by combustion air inlet damper 84.

Figure 6:
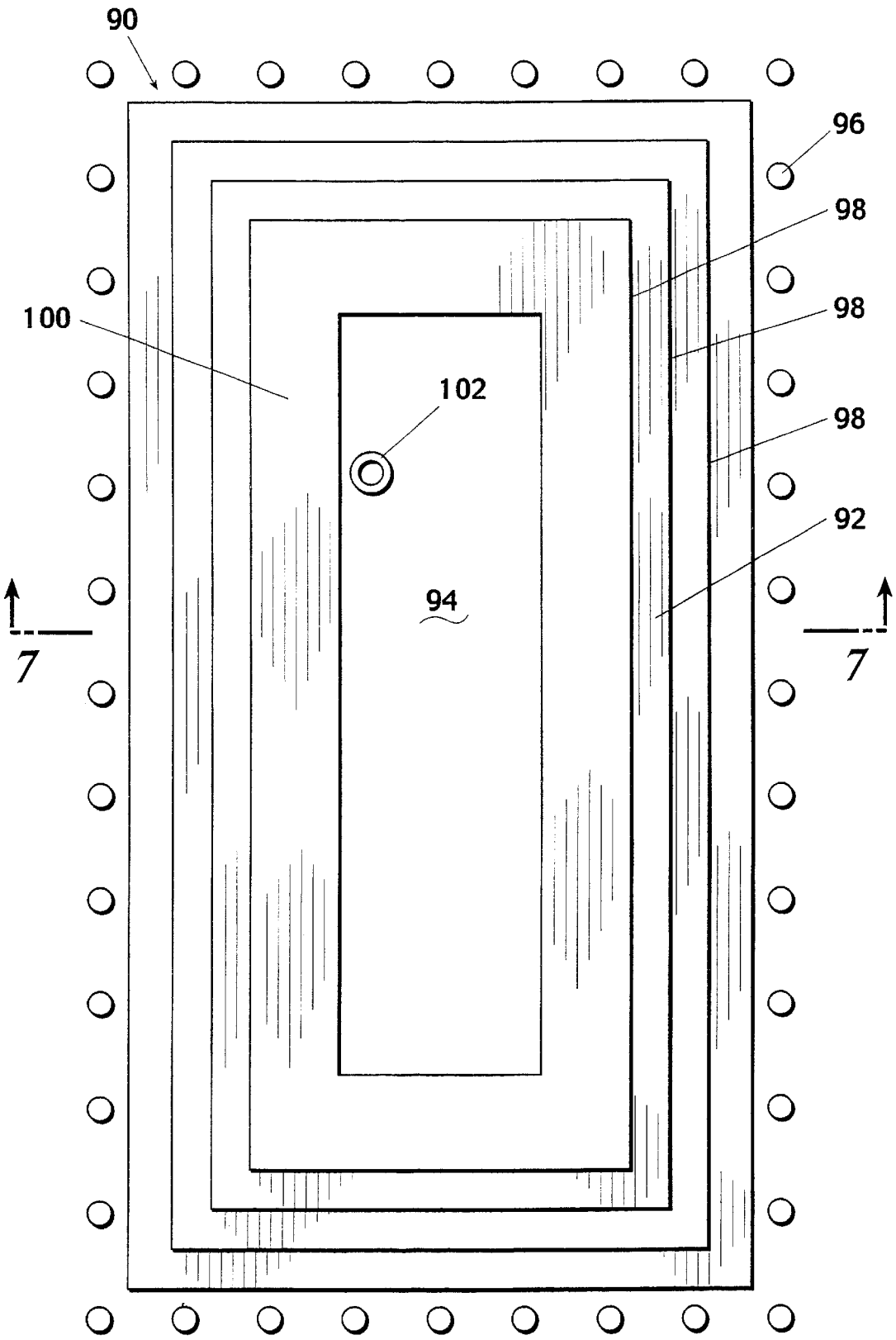
FIG. 6 is a top view of a rectangular form 90 of inventive burner 10.

FIG. 6 depicts a rectangular form 90 of inventive burner 10. FIG. 6 is a top view of the rectangular burner 90 wherein the burner wall 92 possesses a plurality of ledges 98 of a progressively lesser dimension positioned about an outer opening 94 through which combustion air or other oxygen-containing gas passes. A multiplicity of fuel ejection tips 96 are located outside the periphery of the burner wall 92 as afore described. A burner pilot 102 can optionally be located within the interior opening 94 to initiate combustion at the outer end 100 of the burner wall.

Figure 7:
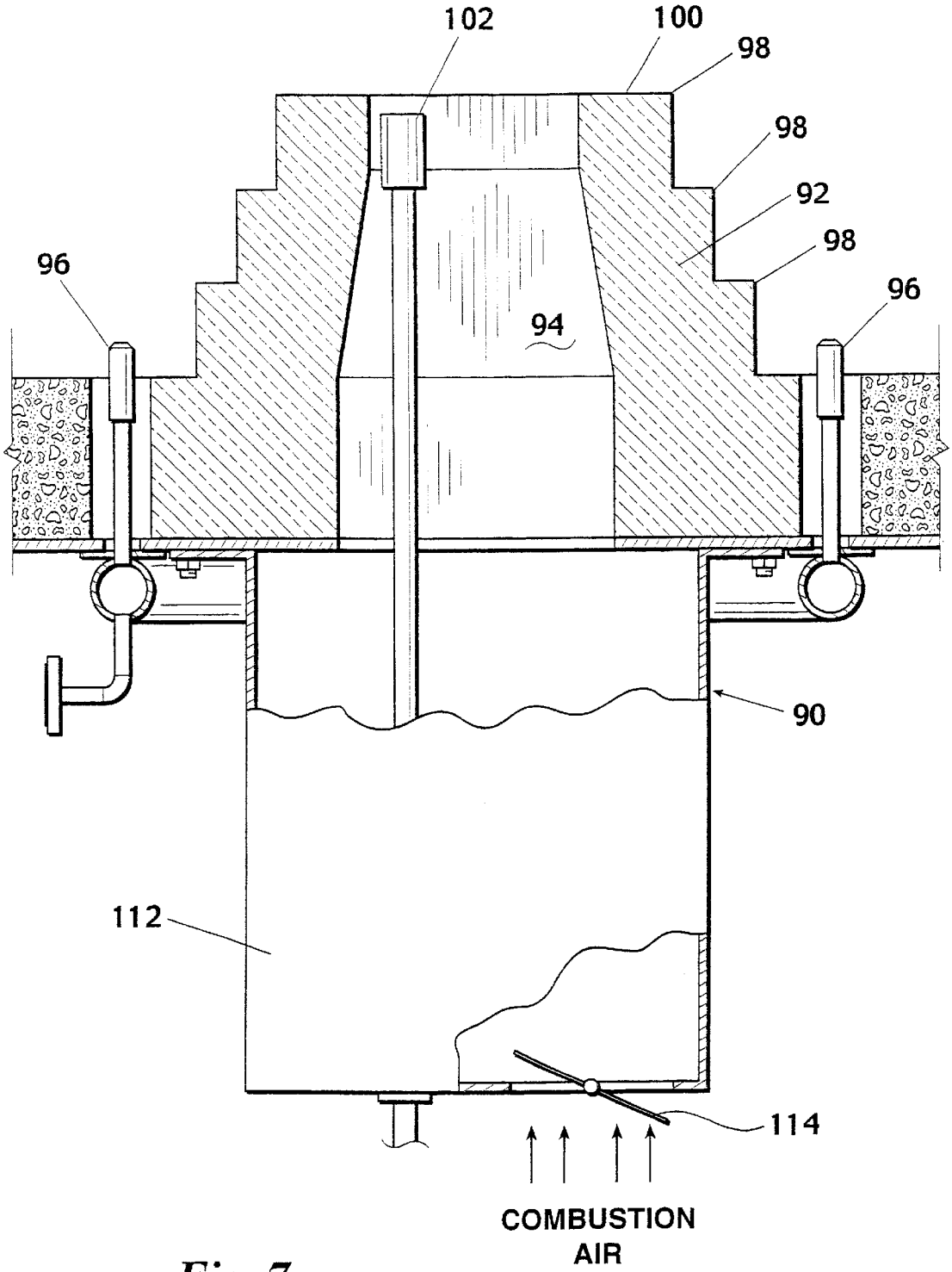
FIG. 7 is a cutaway elevational view of rectangular burner 90 as seen from perspective B—B shown in FIG. 6.

FIG. 7 provides a sectional view of inventive rectangular burner 90. The burner has a rectangular housing 112 through which combustion air or other oxygen-containing gas is directed to the interior passageway 94 extending through burner wall 92. The quantity of combustion air entering the rectangular housing 112 is regulated by combustion air inlet damper 114.

Figure 8:
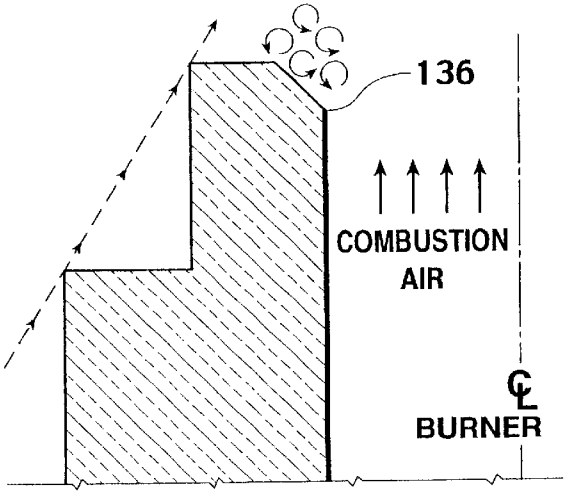
FIG. 8 is a partial, cutaway elevational view of an embodiment 136 of an inventive structure for providing a reduced pressure region.
Figure 9:
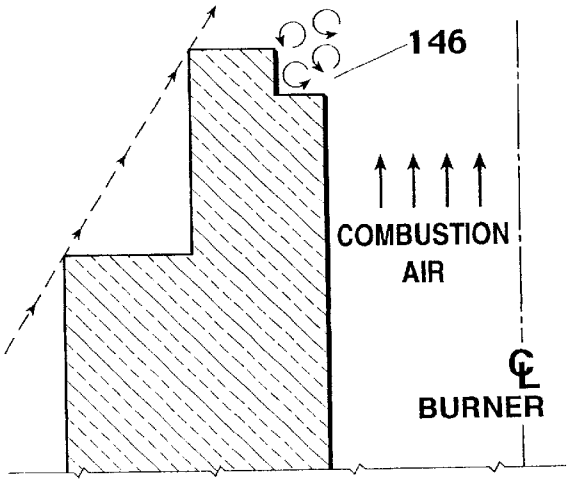
FIG. 9 is a partial, cutaway elevational view of an alternative embodiment 146 of the inventive structure for providing a reduced pressure region.

FIGS. 9 and 8 depict structures of a type which can desirably be used in any of the embodiments described above to provide a reduced pressure region at the outer end of the burner wall. The structure employed in FIG. 9 is a radial shoulder 146 formed just inside of the outer end of the air flow passageway. The structure employed in FIG. 8 is a sloped, outwardly diverging surface 136 formed just inside of the outer end of the air flow passageway. Such structures preferably do not extend more than one inch, most preferably not more than one-half inch, into the outer end of the air flow passageway. These or similar structures provide a reduced pressure zone at the outlet end of the air flow passageway which will assist in drawing the combustion flame to and holding the flame at the outer/forward end of the burner wall. The reduced pressure region thus assists in stabilizing the burner operation and also assists in mixing the combustion air or other oxygen-containing gas with the fuel/flue gas streams.

EXAMPLE

Figure 2:
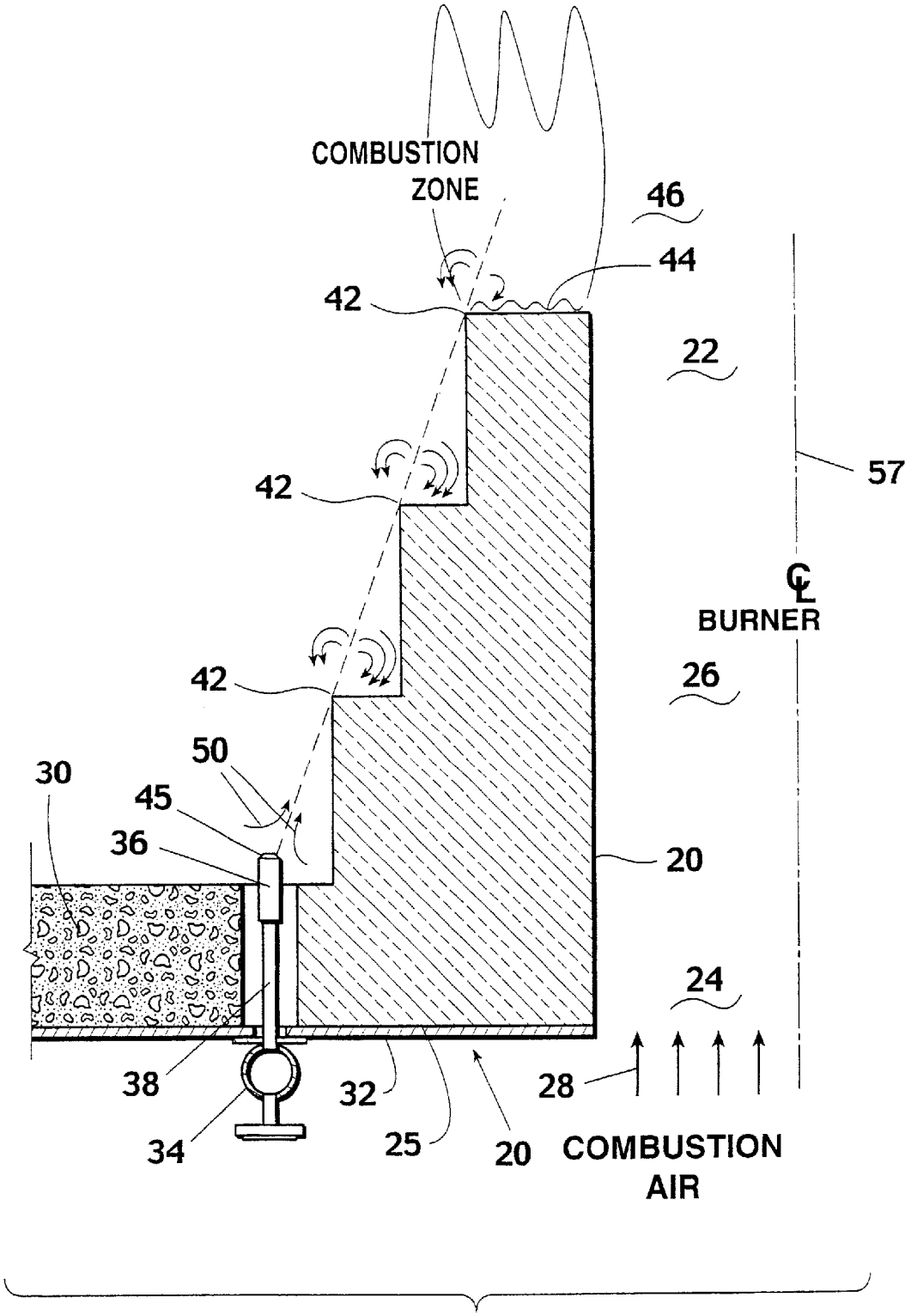
FIG. 2 is a partial, cutaway elevational view of burner 10.

An inventive circular burner of the type depicted in FIG. 2 was installed in a test furnace. Natural gas (918 BTU per standard cubit foot) was delivered to the burner at a pressure of 25 psig and a flow rate of 3,268 standard cubic feet per hour. The natural gas was discharged from a total of 24 jet flow fuel ejection tips surrounding the burner wall so that furnace flue gas was entrained in and mixed therewith. Further mixing was accomplished by conducting the streams across three impact ledges provided on the exterior of the burner wall. The fuel gas/furnace flue gas streams were mixed and combusted with air at the forward end of the burner. The air was supplied at a rate of 8% by volume in excess of stoichiometric requirements and was regulated by means of the burner damper. The furnace temperature during operation was 1700° F., resulting in $NO_x$ emissions from the furnace stack of less than 6 ppm by volume.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A burner providing reduced $NO_x$ emissions for use in a heating system having a flue gas therein, said burner comprising:

a burner wall having a forward end and a series of fuel gas ejectors, each having only a single fuel gas ejection port provided therein, said ejectors and said single fuel gas ejection ports provided therein being positioned and said fuel gas ejection ports being configured to deliver fuel gas from said ejectors in a plurality of adjacent free jet flow streams outside of said burner wall toward a combustion zone at said forward end of said burner wall, each of said adjacent free jet flow streams being effective for entraining a portion of said flue gas in said fuel gas, and wherein said fuel gas ejection ports are positioned longitudinally rearward and laterally outward with respect to said forward end of said burner wall and said fuel gas ejection ports are oriented such that said forward end of said burner wall will be contacted by at least a portion of said fuel gas traveling in said flow streams.

2. The burner of claim 1 wherein said fuel gas ejection ports are configured to eject said fuel gas therefrom at a velocity in the range of from about 1100 to about 1300 feet per second.

3. The burner of claim 1 having no other impact structures in said flow streams between said fuel gas ejection ports and said forward end of said burner wall.

4. A burner providing reduced $NO_x$ emissions for use in a beating system having a flue gas therein, said burner comprising:

a burner wall having a forward end;

said burner having only a single combustion stage, said single combustion stage having a beginning end located substantially at said forward end of said burner wall;

a plurality of fuel gas ejectors positioned longitudinally rearward of an laterally outward from said forward end of said burner wall; and a plurality of fuel gas ejectors positioned longitudinally rearward of and laterally outward from said forward end of said burner wall; and said fuel gas ejectors being configured and positioned to deliver fuel gas to said single combustion stage in ejection flow paths outside of said burner wall in a manner effective such that at least a portion of said fuel gas delivered by said fuel gas ejectors will be combusted at said beginning end of said combustion zone and at least a sufficient portion of said flue gas is entrained in said fuel gas to yield total $NO_x$ emissions of less than 10 parts per million by volume of all combustion product gases produced by said burner, wherein said burner comprises at least ten of said fuel gas sectors positioned in series and spaced from about 1 inch to about 4 inches apart.

5. The burner of claim 4 wherein said fuel gas ejectors are spaced from about 1inch to about 3 inches apart.

6. The burner of claim 4 wherein each of said fuel gas ejectors has only a single fuel gas ejection port and said fuel gas ejection ports are configured and oriented in a manner effective to deliver said fuel gas from said ejectors in adjacent free jet flow streams.

7. A burner providing reduced $NO_x$ emissions comprising:

a burner wall having a forward end;

at least one fuel gas nozzle positioned longitudinally rearward of and laterally outward from said forward end of said burner wall;

at least one fuel gas delivery port positioned in said fuel gas nozzle to deliver fuel gas in a flow path outside of said burner wall to a combustion zone at said forward end of said burner wall; and at least one exterior ledge provided on said burner wall and positioned between said fuel gas delivery port and said forward end of said burner wall such that at least a portion of said fuel gas traveling in said flow path will contact said exterior ledge; said exterior ledge being spaced apart from said forward end.

8. The burner of claim 7 wherein said exterior ledge is positioned longitudinally rearward of and laterally outward from said forward end of said burner wall.

9. A burner providing reduced $NO_x$ emissions comprising:

a burner wall having a forward end;

at least one fuel gas nozzle having at least one fuel gas delivery port positioned therein to deliver fuel gas in a flow path outside of said burner wall to a combustion region at said forward end of said burner wall; and a plurality of impact structures, not including said forward end of said burner wall, positioned such that each of said impact structures will be contacted by at least a portion of said fuel gas traveling in said flow path.

10. The burner of claim 9 wherein said impact structures are spaced apart from each other.

11. The burner of claim 10 wherein said impact structures include a first exterior ledge and a second exterior ledge provided on said burner wall.

12. The burner of claim 11 wherein said second exterior ledge is positioned longitudinally forward and laterally inward of said first exterior ledge.

13. The burner of claim 12 wherein said second exterior ledge is positioned longitudinally rearward and laterally outward from said forward end of said burner wall.

14. A method of reducing $NO_x$ emissions from a burner used in a heating system having a flue gas therein, wherein said burner includes a burner wall having a forward end and an interior passageway with an outlet at said forward end, said method comprising the steps of:

(a) ejecting fuel gas outside of said burner wall in free jet flow such that at least a portion of said flue gas is entrained in said fuel gas and said fuel gas travels outside of said burner wall to a combustion zone having a beginning end substantially at said forward end of said burner wall and (b) delivering air or other oxygen-containing gas to said combustion zone via said interior passageway, said burner being operated in said method as a single stage burner wherein substantially all of said fuel gas ejected outside of said burner wall in step (a) is combusted in said combustion zone and at least a portion of said fuel gas ejected outside of said burner wall in step (a) is combusted at said beginning end of said combustion zone.

15. The method of claim 14 wherein said fuel gas traveling outside of said burner wall to said combustion zone entrains at least a sufficient portion of said flue gas to yield total $NO_x$ emissions from said burner of less than 10 parts per million by volume of all combustion product gases produced by said burner.

16. The method of claim 14 further comprising the step of contacting at least one impact structure with at least a portion of said fuel gas as said fuel gas travels outside of said burner wall to said combustion zone.

17. The method of claim 16 wherein at least two impact structures are contacted by said fuel gas in said step of contacting.

18. The method of claim 17 wherein said impact structures are spaced apart from each other.

19. The method of claim 18 wherein said impact structures comprise exterior ledges formed on said burner wall and spaced rearwardly from said forward end of said burner wall.

20. The method of claim 16 wherein said impact structure is an exterior ledge formed on said burner wall and spaced rearwardly from said forward end of said burner wall.

21. The method of claim 14 wherein said fuel gas is ejected in step (a) at a velocity in the range of from about 1100 to about 1300 feet per second.

22. The method of claim 14 further comprising the step of creating a reduced pressure region at said outlet end of said interior passageway to assist in mixing at least a portion of said fuel gas with at least a portion of said air or other oxygen-containing gas.

23. The method of claim 22 wherein said reduced pressure region is created using a shoulder formed in said interior passageway adjacent said forward end of said burner wall.

24. The method of claim 22 wherein said reduced pressure region is created using an angled surface in said outlet of said interior passageway.

25. The method of claim 14 wherein, in step (a), said fuel gas is ejected from a series of ejectors spaced from about 1 inch to about 4 inches apart.

26. The method of claim 25 wherein said ejectors are spaced from about 1 inch to about 3 inches apart.

27. The method of claim 14 wherein, in step (a), said fuel gas is ejected from at least 10 ejectors surrounding said burner wall.

28. The method of claim 27 wherein said ejectors are spaced from about 1 inch to about 4 inches apart.

29. The method of claim 27 wherein said ejectors are spaced about 2 inches apart.

30. A burner providing reduced $NO_x$ emissions for use in a heating system having a flue gas therein, said burner comprising:

a burner wall having a forward end;

a series of fuel gas ejectors, each having only a single fuel gas ejection port provided therein, said ejectors and said single fuel gas ejection ports provided therein being positioned and said fuel gas ejection ports being configured to deliver fuel gas from said ejectors in a plurality of adjacent fee jet flow streams outside of said burner wall toward a combustion zone at said forward end of said burner wall, each of said adjacent free jet flow streams being effective for entraining a portion of said flue gas in said fuel gas and said fuel gas ejection ports being positioned longitudinally rearward laterally outward with respect to said forward end of said burner wall; and an impact structure positioned between said fuel gas ejection ports and said forward end of said burner wall such that said impact structure will be contacted by at least a portion of said fuel gas traveling in said flow streams.

31. The burner of claim 30 wherein said impact structure is an exterior ledge provided on said burner wall.

32. The burner of claim 31 wherein said exterior ledge is spaced longitudinally rearward of and laterally outward from said forward end of said burner wall.

33. The burner of claim 32 wherein:

said burner wall has a longitudinal axis and said fuel gas ejection ports are oriented such that said flow streams leave said fuel gas ejection ports at an angle from said longitudinal axis in the range of from about 13° to about 26°.

34. A burner providing reduced $NO_x$ emissions for use in a heating system having a flue gas therein, said burner comprising:

a burner wall having a forward end;

a series of fuel gas ejectors, each having only a single fuel gas ejection port provided therein, said ejectors and said single fuel gas ejection ports provided therein being positioned and said fuel gas ejection ports being configured to deliver fuel gas from said ejectors in a plurality of adjacent free jet flow streams outside of said burner wall toward a combustion zone at said forward end of said burner wall, each of said adjacent free jet flow streams being effective for entraining a portion of said flue gas in said fuel gas and said fuel gas ejection ports being positioned longitudinally rearward and laterally outward with respect to said forward end of said burner wall;

said fuel gas ejection ports being oriented such that said forward end of said burner wall will be contacted by at least a portion of said fuel gas traveling in said flow streams; and a plurality of impact structures positioned between said fuel gas ejection ports and said forward end of said burner wall such that each of said impact structures will be contacted by at least a portion of said fuel gas traveling in said flow streams.

35. The burner of claim 34 wherein said impact structures are spaced apart from each other.

36. The burner of claim 35 wherein said impact structures include a first exterior ledge and a second exterior ledge provided on said burner wall.

37. The burner of claim 36 wherein said second exterior ledge is positioned longitudinally forward of and laterally inward from said first exterior ledge.

38. The burner of claim 37 wherein said second exterior ledge is positioned laterally outward from said forward end of said burner wall.

39. A burner providing reduced $NO_x$ emissions for use in a heating system having a flue gas therein, said burner comprising:

a burner wall having a forward end and a series of fuel gas ejectors, each having only a single fuel gas ejection port provided therein, said ejectors and said single fuel gas ejection ports provided therein being positioned and said fuel gas ejection ports being configured to deliver fuel gas from said ejectors in a plurality of adjacent free jet flow streams outside of said burner wall toward a combustion zone at said forward end of said burner wall, each of said adjacent free jet flow streams being effective for entraining a portion of said flue gas in said fuel gas and said burner having a pressure reduction region at said forward end of said burner wall.

40. A burner providing reduced $NO_x$ emissions for use in a heating system having a flue gas therein, said burner comprising:

a burner wall having a forward end and a series of fuel gas ejectors, each having only a single fuel gas ejection port provided therein, said ejectors and said single fuel gas ejection ports provided therein being positioned and said fuel gas ejection ports being configured to deliver fuel gas from said ejectors in a plurality of adjacent free jet flow streams outside of said burner wall toward a combustion zone at said forward end of said burner wall, each of said adjacent free jet flow streams being effective for entraining a portion of said flue gas in said fuel gas and wherein said burner wall has an interior passageway for flow of air or other oxygen-containing gas out of said forward end and said burner further comprises a shoulder in said interior passageway adjacent said forward end of said burner wall for creating a reduced pressure region at said forward end.

41. A burner providing reduced $NO_x$ emissions for use in a heating system having a flue gas therein, said burner comprising:

a burner wall having a forward end and a series of fuel gas ejectors, each having only a single fuel gas ejection port provided therein, said ejectors and said single fuel gas ejection ports provided therein being positioned and said fuel gas ejection ports being configured to deliver fuel gas from said ejectors in a plurality of adjacent free jet flow streams outside of said burner wall toward a combustion zone at said forward end of said burner wall, each of said adjacent free jet flow streams being effective for entraining a portion of said flue gas in said fuel gas and wherein said burner wall has an interior passageway for flow of air or other oxygen-containing gas out of said forward end and said burner further comprises an angled surface in said interior passageway for creating a reduced pressure region at said forward end.

42. A burner providing reduced $NO_x$ emissions for use in a heating system having a flue gas therein, said burner comprising:

a burner wall having a forward end and a series of fuel gas ejectors, each having only a single fuel gas ejection port provided therein, said ejectors and said single fuel gas ejection ports provided therein being positioned and said fuel gas ejection ports being configured to deliver fuel gas from said ejectors in a plurality of adjacent free jet flow streams outside of said burner wall toward a combustion zone at said forward end of said burner wall, each of said adjacent free jet flow streams being effective for entraining a portion of said flue gas in said fuel gas and wherein said series comprises at least ten of said fuel gas ejectors and said fuel gas ejectors are spaced from about 1 inch to about 4 inches apart.

43. The burner of claim 42 wherein said fuel gas ejectors are spaced from about 1 inch to about 3 inches apart.

44. A burner providing reduced $NO_x$ emissions for use in a heating system having a flue gas therein, said burner comprising:

a burner wall having a forward end and a series of fuel gas ejectors, each having only a single fuel gas ejection port provided therein, said ejectors and said single fuel gas ejection ports provided therein being positioned and said fuel gas ejection ports being configured to deliver fuel gas from said ejectors in a plurality of adjacent free jet flow streams outside of said burner wall toward a combustion zone at said forward end of said burner wall, each of said adjacent free jet flow streams being effective for entraining a portion of said flue gas in said fuel gas and wherein said series of said fuel gas ejectors surrounds said burner wall and said fuel gas ejectors are spaced from about 1 inch to about 4 inches apart.

45. The burner of claim 44 wherein said fuel gas ejectors are spaced about 2 inches apart.

46. A burner providing reduced $NO_x$ emissions for use in a heating system having a flue gas therein, said burner comprising:

a burner wall having a forward end;

said burner having only a single combustion stage, said single combustion stage having a beginning end located substantially at said forward end of said burner wall;

a plurality of fuel gas ejectors positioned longitudinally rearward of and laterally outward from said forward end of said burner wall; and said fuel gas ejectors being configured and positioned to deliver fuel gas to said single combustion stage in ejection flow paths outside of said burner wall in a manner effective such that at least a portion of said fuel gas delivered by said fuel gas ejectors will be combusted at said beginning end of said combustion zone and at least a sufficient portion of said flue gas is entrained in said fuel gas to yield total $NO_x$ emissions of less than 10 parts per million by volume of all combustion product gases produced by said burner, wherein said fuel gas ejectors surround said burner wall and are spaced from about 1 inch to about 4 inches apart.

47. The burner of claim 46 wherein said fuel gas ejectors are spaced about 2 inches apart.

48. A burner providing reduced $NO_x$ emissions for use in a heating system having a flue gas therein, said burner comprising:

a burner wall having a forward end;

said burner having only a single combustion stage, said single combustion stage having a beginning end located substantially at said forward end of said burner wall;

a plurality of fuel gas ejectors positioned longitudinally rearward of and laterally outward from said forward end of said burner wall;

said fuel gas ejectors being configured and positioned to deliver fuel gas to said single combustion stage in ejection flow paths outside of said burner wall in in a manner effective such that at least a portion of said fuel gas delivered by said fuel gas ejectors will be combusted at said beginning end of said combustion zone and at least a sufficient portion of said flue gas is entrained in said fuel gas to yield total $NO_x$ emissions of less than 10 parts per million by volume of all combustion product gases produced by said burner; and an impact structure positioned between said fuel gas ejectors and said forward end of said burner wall such that at least a portion of said fuel gas traveling in said flow paths will contact said impact structure.

49. The burner of claim 48 wherein said impact structure is an exterior ledge provided on said burner wall.

50. A burner providing reduced $NO_x$ emissions for use in a heating system having a flue gas therein, said burner comprising:

a burner wall having a forward end;

said burner having only a single combustibe stage, said single combustion stage having a beginning end located substantially at said burner wall;

a plurality of fuel gas ejectors positioned longitudinally rearward of and laterally outward from said forward end of said burner wall;

said fuel gas ejectors being configured and positioned to deliver fuel gas to said single combustion stage in ejection flow paths outside of said burner wall in a manner effective such that at least a portion of said fuel gas delivered by said fuel gas ejectors will be combusted at said beginning end of said combustion zone and at least a sufficient portion of said flue gas is entrained in said fuel gas to yield total $NO_x$ emissions of less than 10 parts per million by volume of all combustion product gases produced by said burner; and a plurality of impact structures positioned between said fuel gas ejectors and said forward end of said burner wall such that each of said impact structures will be contacted by at least a portion of said fuel gas traveling in said flow paths.

51. The burner of claim 50 wherein said impact structures are spaced apart from each other.

52. The burner of claim 51 wherein said impact structures includes a first exterior ledge and a second exterior ledge provided on said burner wall.

53. The burner of claim 52 wherein said second exterior ledge is positioned longitudinally forward of and laterally inward from said first exterior ledge.

54. The burner of claim 53 wherein said second exterior ledge is positioned laterally outward from said forward end of said burner wall.

55. A burner providing reduced $NO_x$ emissions for use in a heating system having a flue gas therein said burner comprising:

a burner wall having a forward end;

said burner having only a single combustion stage, said single combustion stage having a beginning end located substantially at said forward end of said burner wall;

a plurality of fuel gas sectors positioned longitudinally rearward of and laterally outward from said forward end of said burner wall;

said fuel gas ejectors being configured and positioned to deliver fuel gas to said single combustion stage in ejection flow paths outside of said burner wall in a manner effective such that at least a portion of said fuel gas ejectors will be combusted at said beginning end of said combustion zone and at least a sufficient portion of said flue gas is entrained in said fuel gas to yield total $NO_x$ emissions of less than 10 parts per million by volume of all combustion product gases produced by said burner; and a pressure reduction region at said forward end of said burner wall.

56. A burner providing reduced $NO_x$ emissions for use in a heating system having a flue gas therein, said burner comprising:

a burner wall having a forward end;

said burner having only a single combustion stage, said single combustion stage hang a beginning end located substantially at said forward end of said burner wall;

a plurality of fuel gas ejectors positioned longitudinally rearward of and laterally outward from said forward end of said burner wall; and said fuel gas ejectors being configured and positioned to deliver fuel gas to said single combustion stage in ejection flow paths outside of said burner wall in a manner effective such that at least a portion of said fuel gas delivered by said fuel gas ejectors will be combusted at said beginning end of said combustion zone and at least a sufficient portion of said flue gas is entrained in said fuel gas to yield total $NO_x$ emissions of less than 10 parts per million by volume of all combustion product gases produced by said burner, wherein said burner wall has an interior passageway for flow of air or other oxygen-containing gas out of said forward end.

57. The burner of claim 56 further comprising a shoulder in said interior passageway adjacent said forward end of said burner wall for creating a reduced pressure region at said forward end.

58. The burner of claim 56 further comprising an angled surface in said interior passageway for creating a reduced pressure region at said forward end.

* * * * *

UNITED STATES PATENT AND TRADEMARK OFFICE

CERTIFICATE OF CORRECTION

PATENT NO. : 6,499,990 B1 
DATED : December 31, 2002
INVENTOR(S) : Zink et al.

It is certified that error appears in the above-identified patent and that said Letters Patent is hereby corrected as shown below:

Column 10,
The paragraph beginning at line 21 is a duplicate of the paragraph of the paragraph beginning at line 25, contains a grammatical error, and should be deleted.
Line 40, the word “sectors” should be replaced with the word -- ejectors --

Column 12,
Line 33, the word “fee” should be replaced with the word -- free --
Line 38, insert the word -- and -- between the words “rearward” and “laterally”

Column 15,
Line 50, the word “combustibe” should be replaced with the word -- combustion --

Column 16,
Line 15, insert a comma after the word “therein”
Line 22, the word “sectors” should be replaced with the word -- ejectors --
Line 42, the word “hang” should be replaced with the word -- having --

Signed and Sealed this

Eleventh Day of March, 2003

JAMES E. ROGAN
*Director of the United States Patent and Trademark Office*